United States Patent [19]

Givens

[11] Patent Number: 4,581,194

[45] Date of Patent: Apr. 8, 1986

[54] METHOD AND SYSTEM FOR CONTROLLING AN ACCELERATOR-TYPE NEUTRON SYSTEM

[75] Inventor: Wyatt W. Givens, Dallas, Tex.

[73] Assignee: Mobil Oil Corporation, New York, N.Y.

[21] Appl. No.: 735,303

[22] Filed: May 17, 1985

Related U.S. Application Data

[63] Continuation of Ser. No. 506,916, Jun. 22, 1983, abandoned.

[51] Int. Cl.[4] ..... G21G 4/02

[52] U.S. Cl. ..... 376/119

[58] Field of Search ..... 376/108, 109, 110, 111, 376/113, 114, 118, 119

[56] References Cited

U.S. PATENT DOCUMENTS

| | | | |
|---|---|---|---|
| 2,983,834 | 5/1961 | Reiffel | 376/114 |
| 2,994,777 | 8/1981 | Tittle | 376/114 |
| 3,173,013 | 3/1965 | Braddock et al. | 376/119 |
| 3,719,827 | 3/1973 | Dennis | 376/119 |
| 4,264,823 | 4/1981 | Sloughter et al. | 376/108 |
| 4,282,440 | 8/1981 | Givens | 376/114 |
| 4,404,163 | 9/1983 | Bridges | 376/119 |

*Primary Examiner*—Charles T. Jordan
*Assistant Examiner*—Richard Klein
*Attorney, Agent, or Firm*—A. J. McKillop; Michael G. Gilman; G. W. Hager, Jr.

[57] ABSTRACT

An accelerator-type neutron source employs a target, an ionization section and a replenisher for supplying accelerator gas. A positive voltage pulse is applied to the ionization section to produce a burst of neutrons. A negative voltage pulse is applied to the ionization section upon the termination of the positive voltage pulse to effect a sharp cut-off to the burst of neutrons.

6 Claims, 7 Drawing Figures

FIG. 1
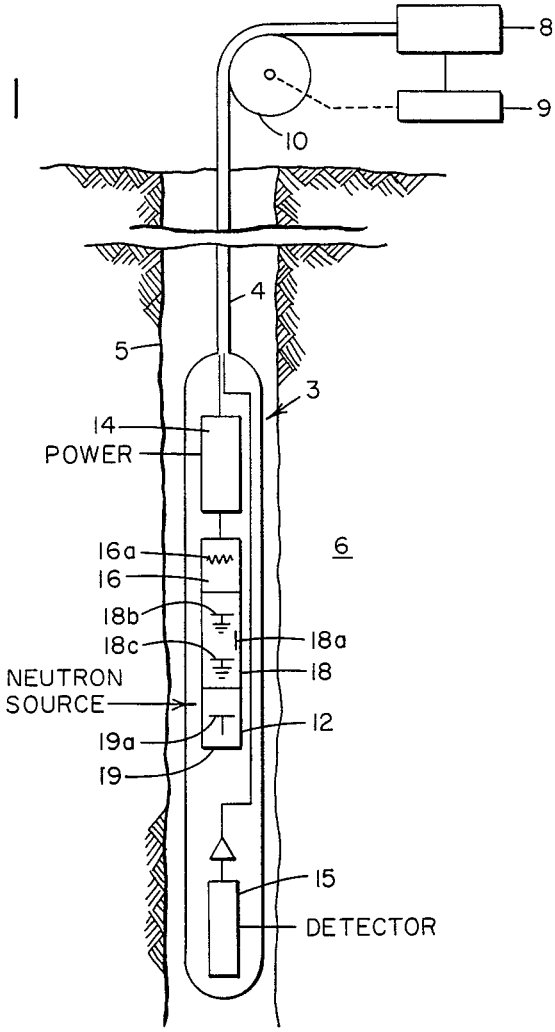
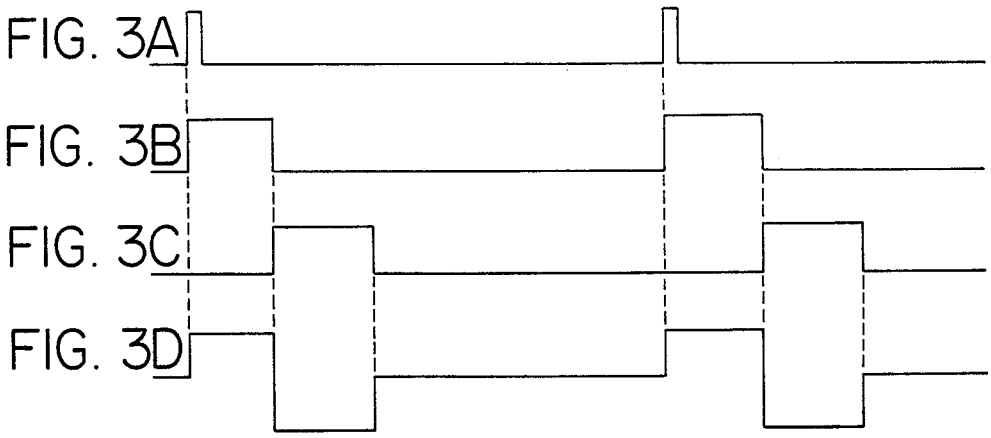

METHOD AND SYSTEM FOR CONTROLLING AN ACCELERATOR-TYPE NEUTRON SYSTEM

This is a continuation of copending application Ser. No. 506,916, filed on June 22, 1983 abandoned.

BACKGROUND OF THE INVENTION

This invention relates to neutron sources and more particularly to the control of accelerator-type neutron tube sources.

Accelerator-type neutron tube sources are employed in many applications. A well known application is in the radioactivity logging of wells penetrating subterranean formations. For example, in the art of neutron-neutron well logging a source of primary neutrons is employed to irradiate subterranean formations of interest. The resulting secondary radiation is measured by one or more detectors spaced axially from the source within the borehole. Such secondary irradiation may take the form of thermal neutrons, epithermal neutrons, or thermal neutron capture gamma rays. A logging tool of this type employed for porosity measurements is disclosed in U.S. Pat. No. 4,005,290 to Allen wherein the logging tool includes a neutron source and epithermal and thermal neutron detectors.

In procedures such as porosity logging, the neutron source is a continuous source usually of a chemical type. Other well known radioactive well logging techniques involve the use of pulsed neutron sources. For example, in the art of radioactive assay well logging an assay tool is lowered into the well to the level of a formation to be assayed. The assay operation is then carried out by cyclically operating a neutron source in the tool in order to irradiate the formation under investigation with repetitive bursts of fast neutrons. In one assay procedure, disclosed in U.S. Pat. No. 3,686,503 to Givens et al, delayed fission neutrons emitted by uranium within the formation may be detected by a neutron detector. Another procedure, disclosed in U.S. Pat. No. 4,180,730 to Givens et al, involves detection of prompt fission neutrons emitted from uranium in the formation. Pulsed neutron logging techniques may also be employed in procedures in which radioactive decay rates are determined. Thus, the formation under investigation is irradiated with a burst of fast neutrons and the resulting neutron population is detected during successive or overlapping time windows. For example, U.S. Pat. No. 3,800,150 to Givens discloses a pulsed neutron logging technique in which epithermal neutron decay or thermal neutron decay is measured by employing time windows for detection which partially overlap one another.

Neutron sources such as may be employed in radioactive logging procedures as described above may take the form of accelerator-type neutron tubes comprising a target section, a replenisher section, and an ionization section located between the target and the replenisher section. The replenisher section provides a source of accelerator gas to the ionization section where it is ionized and then accelerated to impact the target. The target is formulated of material which responds to the bombarding ions to produce neutrons. In a number of well known accelerator-type tube sources, heavy isotopes of hydrogen are employed as the accelerator gas and in the target. For example, the accelerator gas may take the form of deuterium or mixtures of deuterium and tritium and the target may include tritium molecules, deuterium molecules or mixtures of deuterium and tritium molecules. The so-called deuterium-tritium nuclear reaction is one commonly employed in an accelerator-type neutron tube to produce neutrons. In the replenisher section a filament or resevoir usually made of zirconium or titanium is electrically heated (under controlled conditions) to release deuterium gas previously adsorbed in the filament or reservoir. Zirconium and titanium have the property of adsorbing copious quantities of different gases such as hydrogen, deuterium, tritium, and other gases. These materials have the further property of releasing the hydrogen isotope gases under a controlled release condition when heated to about 300° C. and at the same time retaining other gases that may have been adsorbed. The deuterium molecules are ionized in the ionizing section by the application of a positive voltage to an anode in the ionizing section. The deuterium ions are then accelerated and impact the tritium target to produce a supply of neutrons.

While various techniques may be employed in ionizing the accelerator gas, one ionization technique which is suitable particularly where the neutron source is operated at a low accelerator gas pressure and in a pulsed mode is the so-called Penning method. A Penning ion source comprises spaced cathodes and an anode located intermediate the cathodes. In a cold-cathode type Penning ion source, electrons are emitted from a cathode surface by field emissions when a positive voltage pulse is applied to the anode. A magnet associated with the source functions to spiral the electrons thus increasing their flight path and increasing the statistical probability that they will collide with molecules of accelerator gas supplied to the ionization chamber. In a well designed Penning ion source, some of the electrons originating at one cathode surface will impact the other cathode surface and secondary electrons are emitted which also function to increase the ionization reactions. Such ion sources are well known to those skilled in the art and are described in Flinta, J. "Pulsed High-Intensity Ion Source", Part I; Pauli, R. and Flinta, J. "Pulsed High-Intensity Ion Source", Part II, Nuclear Instruments 2, pp 219–236 (1958). In a hot-cathode type Penning ion source, one cathode is a heated filament and initial electrons are supplied by thermionic emission from the filament. In all other respects, cold-cathode and hot-cathode Penning ion sources are essentially the same. Hot-cathode ion sources are also well known to those skilled in the art and one such source is described in Wood, J. and Crocker, A. "An Electrostatically Focused Ion Source And Its Use In A Sealed-Off D.C. Neutron Source". Nuclear Instruments And Methods 21, 47–48 (1963).

SUMMARY OF THE INVENTION

In accordance with the present invention, there is provided a new and improved method and system for controlling the operation of an accelerator-type neutron source having a target, an ionization section and a replenisher for supplying accelerator gas and in which the accelerator gas is ionized upon the application of a positive voltage to the ionization section and accelerated toward the target for the production of neutrons. More paticularly, a positive voltage pulse is produced during a desired time period for each burst of neutrons from the neutron source. This positive voltage pulse is applied to the ionization section to produce the burst of neutrons during the desired time period. A negative voltage pulse is produced upon the termination of the positive voltage pulse and is applied to the ionization section to effect a sharp cut-off to the burst of neutrons.

In carrying out such control over the operation of the accelerator-type neutron source there are produced clock pulses at the desired repetition rate for said bursts of neutrons. For each clock pulse there is produced a first gating signal having a time period equal to the time period desired for each burst of neutrons. A second gating signal is produced in response to the termination of the first gating signal. The first gating signal causes a first pulse forming network to produce a positive voltage pulse during the time period of such first gating signal. The second gating signal causes a second pulse forming network to produce a negative voltage pulse. These positive and negative voltage pulses are applied to the ionization section of the neutron source to control each burst of neutrons as described above.

The first pulse forming network is connected across the upper primary portion of a center-tapped pulse transformer and a second pulse forming network is connected across the lower primary portion of the center-tapped pulse transformer. Both the first and second pulse forming networks are charged through a voltage source. A first switching means connected across the first pulse forming network is activated by the first gating signal to effect a discharge of such first pulse forming network. This produces a discharge current flow in the upper primary portion of the center-tapped transformer, which in turn creates the positive voltage pulse in the secondary of the transformer. A second switching means connected across the second pulse forming network is activated by the second gating signal to effect a discharge of such second pulse forming network. This produces a discharge current flow in the lower primary portion of the center-tapped pulse transformer, which in turn creates the negative voltage pulse in the secondary of the transformer.

BRIEF DESCRIPTION OF THE DRAWINGS

FIG. 1 is a schematic illustration of a radioactive well logging tool employing an accelerator-type neutron tube.

FIGS. 3A–3D represent waveforms of signals at various points within the embodiment of FIGS. 2 and 4.

DESCRIPTION OF THE PREFERRED EMBODIMENT

Figures 2, 4:
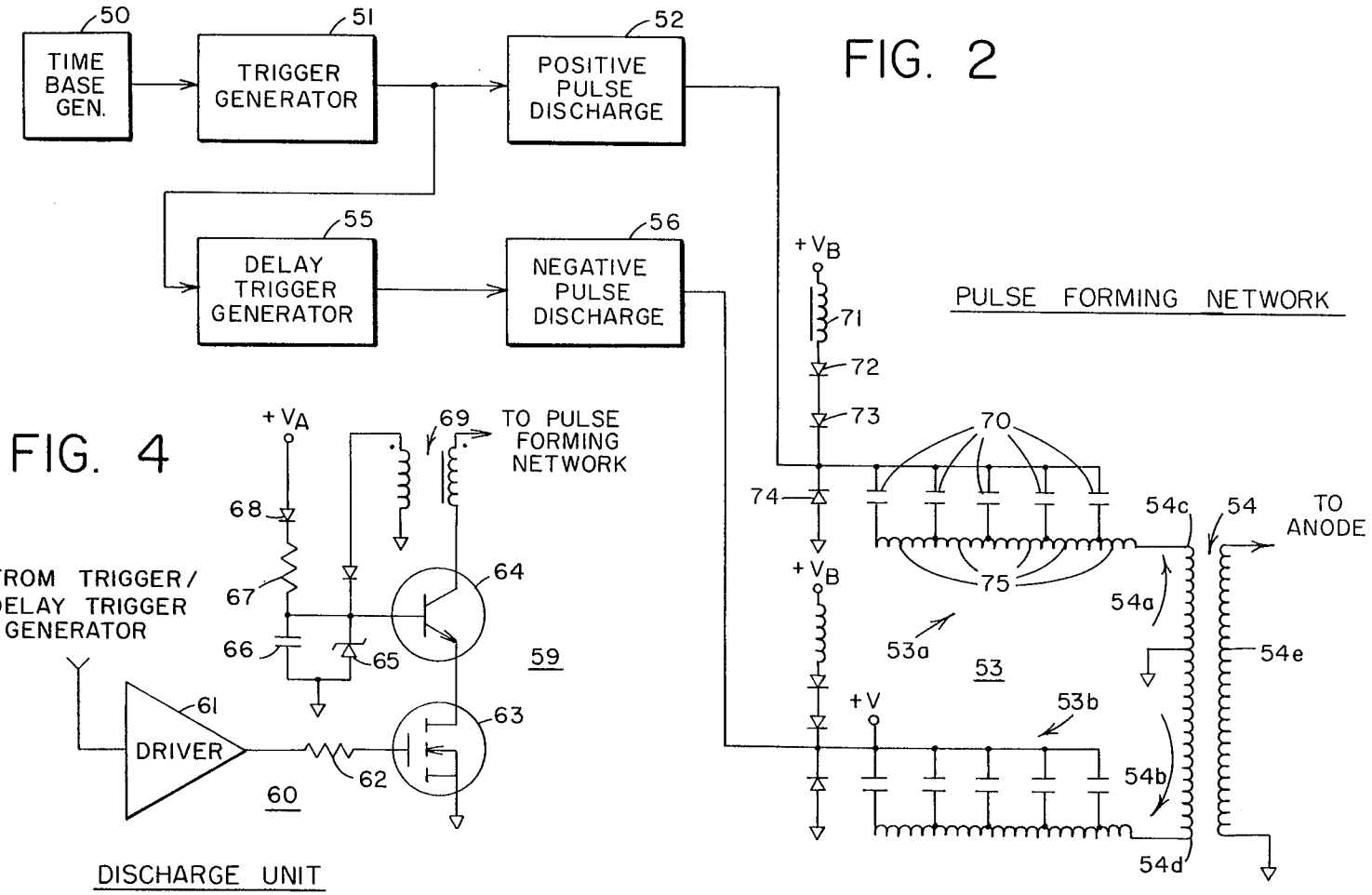
FIGS. 2 and 4 are electrical schematics of a preferred embodiment of the present invention used to control the accelerator-type neutron tube of FIG. 1.

Referring to FIG. 1, the invention will be described with respect to a preferred application in a radioactive well logging system and particularly one in which the neutron source is operated in a pulsed mode. The well logging system comprises a logging tool 3 which is suspended from a cable 4 within a well 5 traversing a subterranean formation of interest indicated by reference numeral 6. The well bore may be lined or unlined with casing but will normally be filled with a fluid such as drilling mud, oil or water. Signals from the logging tool are transmitted uphole via suitable conductors in the cable 4 to an uphole analysis and control circuit 8. Circuit 8 operates on the downhole measurements and applies one or more output functions to a recorder 9. In addition, circuit 8 transmits certain control functions to the logging tool via conductors in cable 4. As the logging tool is moved through the hole, a depth recording means, such as measuring sheave 10, produces a depth signal which is applied to recorder 9, thus correlating the downhole measurements with the depths at which they are taken.

The logging tool 3 comprises a pulsed neutron source 12, a downhole power supply 14 for the source, and a radiation detector 15, which responds to primary or secondary radiation in the formation in response to the output of the pulsed neutron source. For example, the detector 15 may be a gamma ray detector, a thermal neutron detector or an epithermal neutron detector. While only one detector is shown, it will be recognized that such logging tools may comprise a plurality of detectors responsive to similar or dissimilar radiation.

The pulsed neutron source is an accelerator-type neutron tube comprising a replenisher section 16, an ionization section 18, and a target section 19. Replenisher section 16 may comprise replenisher element **16*a* which releases deuterium gas in response to an applied DC or AC voltage from power supply 14. Target section 19 comprises a tritium target 19*a*. The target section will also typically include an extraction-focusing electrode assembly and a negative high voltage supply (not shown) which functions to direct ions from the ionization section 18 to the target 19*a* while suppressing the counter current flow of secondary electrons produced by ion impact on the target. The ionization section 18 includes anode means 18*a* and cathode means 18*b* and 18*c***.

The neutron source 12 may be operated in a continuous or in a pulsed mode. In either mode of operation, deuterium gas released upon the application of power to the replenisher element 16 enters the ionization section 18 where the gas molecules are ionized by a positive (with respect to cathodes **18*b* and 18*c*) ionization voltage applied across anode 18 and cathodes 18*b* and 18*c*. The deuterium ions formed in the ionization section are then accelerated toward the target 19*a* by a negative voltage applied to the target section. For example, a positive voltage or voltage pulse with an amplitude from a few hundred volts to a few kilovolts may be applied to anode member 18*a* and a— 100 kilovolt voltage applied to target section 19**.

Referring now to FIG. 2 there is shown a preferred embodiment of the present invention for use in triggering the ionization section of the accelerator-type neutron tube to produce neutron bursts of short duration and sharp cut-off. More particularly, a time base generator 50 produces clock pulses at a desired repetition rate as shown in FIG. 3A. This repetition rate is the desired firing rate for the pulsed neutron source. Each such clock pulse fires the trigger generator 51, preferably a one-shot multivibrator to provide a trigger pulse as shown in FIG. 3B. A positive pulse discharge unit 52 is activated during the time period of trigger generator 51 to discharge a first portion **53*a* of the pulse forming network 53. This produces the discharge current 54*a* in the direction shown in the top half 54*c* of the center-tapped transformer 54 as shown in FIG. 2. As a result of this discharge, a positive going pulse is produced in the secondary 54*e* of the transformer 54 as shown in the positive position of the waveform of FIG. 3D**.

Upon termination of the trigger pulse of FIG. 3B from trigger generator 51; a delay trigger generator 55 is fired. Trigger generator 55 also preferably includes a one-shot multivibrator for providing a delay trigger pulse as shown in FIG. 3C. A negative pulse discharge unit 56 is activated during the time period of delay trigger generator 55 to discharge a second portion **53*b*** of the pulse forming network 53. This produces the discharge current 54*b* in the direction shown in the bottom half 54*d* of the center-tapped transformer 54 as shown in FIG. 2. As a result of this discharge, a negative going pulse is produced in the secondary 54*e* of the transformer 54 as shown in the negative portion of the waveform of FIG. 3D.

The secondary 54*e* of transformer 54 is connected directly to the ionization section 18 of the neutron source 12. The voltage provided within the secondary 54*e* of transformer 54, as represented by the positive and negative going pulses of FIG. 3D, is applied as the ionization voltage to the anode 18*a* of the neutron source 12. The deuterium gas molecules released by the replenisher 16 enter the ionization section 18 and are ionized by the positive going portion of the ionization voltage applied to the anode 18*a*. These deuterium ions are then accelerated toward the target 19 where, upon impact, they produce the desired burst of neutrons so long as a positive ionization voltage is applied to anode 18*a*.

In accordance with the foregoing description, the present invention provides for a sharp cut-off for each burst of neutrons from the pulsed neutron source through the reversal of the polarity of the ionization voltage to a negative value at the end of the desired burst period. This feature is accomplished by employing the pulse forming network of FIG. 2 as described above to produce the ionization voltage waveform as shown in FIG. 3D. The positive going portion of the waveform is utilized to ionize the deuterium ions while the negative going portion provides the desired sharpness for the cut off of such ionization.

Referring now to FIG. 4 there is shown a discharge unit 60 suitable for use as the positive and negative pulse discharge units 52 and 56. The operation of discharge unit 60 will now be described in conjunction with its use as the positive pulse discharge unit 52. During the time period of the trigger pulse, FIG. 3B, from trigger generator 51, the driver 61 provides current flow through resistor 62 for gating the switching means 59. This switching means is preferably a field effect transistor 63 connected in series with the emitter of a transistor 64 which is base-biased by zener diode 65 from voltage supply $+V_A$ along with capacitor 66, resistor 67 and diode 68. The collector of transistor 64 is connected through the transformer 69 to the pulse forming network 53*a* of FIG. 2. Capacitors 70 of pulse forming network 53*a* are charged to the supply voltage $+V_B$ through the inductance 71, diodes 72, 73 and 74, the inductances 75 and the top portion 54*c* of the center-tapped transformer 54. When the field effect transistor 63 of discharge unit 60 is gated on the charge stored on the capacitors 70 of pulse forming network 53*a* is discharged to ground through transformer 69, transistor 64 and field effect transistor 63*a*. This creates the current flow 54*a* in the top portion 54*c* of the center-tapped transformer 54. The resulting voltage created in the secondary 54*e* of transformer 54 is a positive voltage pulse of about 2 to 3 kilovolts as shown in the positive going portion of the waveform of FIG. 3D. Following the termination of the trigger pulse from trigger generator 51 to driver 61 of the discharge unit, the bank of capacitors 70 of pulse forming network 53*a* charges toward the supply voltage $+V_B$.

In similar operation, the discharge unit as shown in FIG. 4 is utilized as the negative pulse discharge unit 56 to discharge the pulse forming network 53*b* during the time period of the delay trigger generator as shown in FIG. 3C. During this time period the current flow 54*b* is created in the bottom portion 54*d* of the center-tapped transformer 54 to induce a negative voltage pulse of about 2 to 3 kilovolts in the secondary 54*e* of transformer 54 as shown in the negative going portion of the waveform of FIG. 3D.

Having now described the pulse forming network of the present invention in conjunction with the circuitry of FIGS. 2 and 4, it is to be understood that such circuitry is merely representative of one embodiment. In accordance with such embodiment, a 15 microsecond pulse was produced utilizing the following specific types of circuit components.

| Reference Designation | Description |
|---|---|
| Time base generator 50 | CD-4047B (R.C.A.) |
| Trigger generators 51 and 55 | CD-4098BE (R.C.A.) |
| Driver 61 | CD-4098BE (R.C.A.) |
| Field effect transistor 63a | IRF-131 (Inter Ration Rectifier) |
| Transistor 64 | NJ 12005 (Motorola) |
| Zener diode 65 | 30 volt |
| Resistor 67 | 56K, 2 W |
| Capacitor 66 | 0.22 f |
| Transformer primaries 54c and 54d | 50 ohms |
| Transformer secondary | 3.2K |
| $+V_B$ | 150 to 250 volts |
| Pulse forming network 53 | Model 210 (Geotronics) |
| Capacitors 70 | 0.016 μf |
| Inductances 75 | 90 μh |

While a particular embodiment of the present invention has been shown and described, other modifications or alterations may be made without departing from the spirit and scope of the invention as set forth in the appended claims.

What is claimed is:

1. A pulsed neutron source including an accelerator tube having a target, an ionization section having an anode and at least one cathode, and a replenisher for supplying accelerator gas which is ionized by repetitive pulses of ionization voltage applied to the anode of the ionization section, the improvement comprising:

(a) means for producing clock pulses at the desired repetition rate for said pulses of neutrons, (b) means for producing a first gating signal having a time period equal to the desired time period for each pulse of neutrons, (c) means for producing a second gating signal in response to the termination of said first gating signal, (d) a transformer center-tapped on its primary side to provide an upper primary portion and a lower primary portion, (e) a first pulse forming network connected across the upper primary portion of said transformer, (f) a second pulse forming network connected across the lower primary portion of said transformer, (g) means for charging said first and second pulse forming networks, (h) first switching means connected across said first pulse forming network and including a field effect transistor having said first gating signal applied to its gate input, said first switching means being activated during the time period of said first gating signal to produce a current flow through the upper primary portion of said transformer, thereby providing for a positive voltage pulse across the secondary of said transformer for application to the anode of said ionization section for ionizing the gas molecules from the replenisher of said ionization section during acceleration toward the target of said ionization section for the production of neutrons, and (i) second switching means connected across said second pulse forming network and including a field effect transistor having said second gating signal applied to its gate input, said second switching means being activated during the time period of said second gating signal to produce a current flow through the lower primary portion of said transformer, thereby providing for a negative voltage pulse across the secondary of said transformer for application to the anode of said ionization section for driving the ionized gas molecules to the cathode of said ionization section to effect a sharp cut-off to said production of neutrons.

2. A pulsed neutron source comprising:

(a) an accelerator tube having a target, an ionization section having an anode and at least one cathode, and a replenisher for supplying accelerator gas which is ionized and accelerated toward the target for the production of pulses of neutrons, (b) means for producing clock pulses at the desired repetition rate for said pulses of neutrons, (c) means for producing a first gating signal having a time period equal to the desired time period for each pulse of neutrons, (d) means for producing a second gating signal in response to the termination of said first gating signal, (e) a transformer center-tapped on its primary side to provide an upper primary portion and a lower primary portion, (f) a first pulse forming network connected across the upper primary portion of said transformer, (g) a second pulse forming network connected across the lower primary portion of said transformer, (h) means for charging said first and second pulse forming networks, (i) means for discharging said first pulse forming network during the time period of said first gating signal to produce a discharge current flow through the upper primary portion of said transformer, whereby said positive voltage pulse is produced across the secondary of said transformer, (j) means for discharging said second pulse forming network during the time period of said second gating signal to produce a discharge current flow through the lower primary portion of said transformer, whereby said negative voltage pulse is produced across the secondary of said transformer, and (k) means for applying said positive and negative voltage pulses to the anode of said ionization section, whereby said positive voltage pulse provides for the ionization of said accelerator gas during travel toward said target and the resulting production of neutrons during the time period of said positive voltage pulse and said negative voltage pulse drives ionized accelerator gas toward said cathode providing for a sharp cut-off to said ionization and the resulting production of neutrons.

3. The pulsed neutron source of claim 2 wherein said means for discharging said first pulse forming network comprises:

(a) switching means connected across said first pulse forming network and providing a discharge path for said first pulse forming network when activated, and (b) means for applying said first gating signal to said switching means, said switching means being activated during the time period of said first gating signal.

4. The pulsed neutron source of claim 3 wherein said switching means includes a field effect transistor having said first gating signal applied to its gate input.

5. The pulse neutron source of claim 2 wherein said means for discharging said second pulse forming network comprises:

(a) switching means connected across said second pulse forming network and providing a discharge path for said second pulse forming network when activated, and (b) means for applying said second gating signal to said switching means, said switching means being activated during the time period of said second gating signal.

6. The pulsed neutron source of claim 5 wherein said switching means includes a field effect transistor having said second gating signal applied to its gate input.

* * * * *